US005659293A

United States Patent [19]

Shibata et al.

[11] Patent Number: 5,659,293

[45] Date of Patent: Aug. 19, 1997

[54] FITTING STRUCTURE OF ADDRESS UNIT OF FIRE SENSOR

[75] Inventors: Masao Shibata; Toshiyuki Ozawa, both of Tokyo, Japan

[73] Assignee: Hochiki Corporation, Tokyo, Japan

[21] Appl. No.: 556,393

[22] Filed: Nov. 9, 1995

[30] Foreign Application Priority Data

Nov. 11, 1994 [JP] Japan ..... 6-277279

[51] Int. Cl.[6] ..... G08B 17/10

[52] U.S. Cl. ..... 340/628; 340/630; 340/693; 340/578; 340/577; 439/286

[58] Field of Search ..... 340/627, 628, 340/629, 630, 514, 693, 577, 578; 250/573, 574, 575, 576, 577; 73/16; 356/338, 340, 349, 438, 431; 639/286

[56] References Cited

U.S. PATENT DOCUMENTS

| | | | |
|---|---|---|---|
| 4,161,727 | 7/1979 | Thilo et al. | 340/518 |
| 4,988,477 | 1/1991 | Payne et al. | 340/524 |
| 5,021,677 | 6/1991 | Zgarashi et al. | 250/576 |
| 5,083,107 | 1/1992 | Takahashi et lal. | 340/506 |
| 5,357,243 | 10/1994 | Tice | 340/825.07 |
| 5,486,916 | 1/1996 | Ariga et al. | 340/630 |
| 5,530,433 | 6/1996 | Morita | 340/630 |
| 5,574,435 | 11/1996 | Mochizuki | 340/630 |

FOREIGN PATENT DOCUMENTS

| | | | |
|---|---|---|---|
| A10362985 | 4/1990 | European Pat. Off. | G08B 17/00 |
| 0546401 | 6/1993 | European Pat. Off. . | |
| A10546401 | 6/1993 | European Pat. Off. | G08B 26/00 |
| A1582975 | 2/1994 | European Pat. Off. | G08B 17/113 |
| A10592923 | 4/1994 | European Pat. Off. | G08B 17/00 |
| 7823178 | 9/1979 | Germany | G08B 17/00 |

*Primary Examiner*—Jeffery Hofsass
*Assistant Examiner*—Benjamin C. Lee
*Attorney, Agent, or Firm*—Sughrue, Mion, Zinn, Macpeak & Seas

[57] ABSTRACT

A fire sensor according to the present invention includes a sensor base, a sensor body and an address unit. The sensor base is mounted and fixed on a predetermined position, for example, a ceiling. The sensor body includes a plurality of pins for electrically connecting the sensor body with the sensor base, and a first fitting member for electrically and mechanically connecting the sensor body with the sensor base. The plurality of pins are formed on a surface of the sensor body connectable to the sensor base and circumferentially arranged on a circle with a predetermined radius. The sensor base has a second fitting member which is electrically and mechanically fitted to the first fitting member. The address unit is mounted on the sensor base, and includes a nonvolatile memory for electrically setting a readable address of the fire sensor, a first slide groove formed along a path of rotation movement of the plurality of pins, and a plurality of connector members formed along the first slide groove, each of the pins passing through the connector members and electrically connecting to each of the connector corresponding thereto. The plurality of pins are inserted in substantially perpendicular into the first slide groove, and then the sensor body is rotated to fit the pins to the connector members, respectively, and the first fitting member to the second member.

11 Claims, 7 Drawing Sheets

FITTING STRUCTURE OF ADDRESS UNIT OF FIRE SENSOR

BACKGROUND OF THE INVENTION

1. Field of the Invention

The present invention relates to a pin-fitting structure of a base-mount type address unit of a fire sensor in which an address unit including a nonvolatile memory for address-setting purposes is releasable mounted on a sensor base.

2. Description of the Related Art

In a conventional fire sensor of a type which answers a present detection condition in response to polling from a control unit utilizing a sensor address, it is necessary that an inherent address should be set in the fire sensor itself. The setting of the address for the fire sensor is effected usually by means of a nonvolatile memory (e.g. EEPROM) provided on a circuit board housed in a sensor body. When an address-setting circuit is provided in the sensor body itself, predetermined address-setting is effected for each sensor, for example, at the time of shipping from a factory. Needless to say, the address-setting may be effected at an installation site after installation of the sensor. One example in which an EEPROM, storing address, is provided in a sensor body is disclosed in U.S. Pat. No. 4,658,243.

On the other hand, there is a method in which a sensor address is set in a sensor base. In such a case where an address-setting circuit is provided on the sensor base mounted on a ceiling or the like, it is not necessary to effect address-setting relative to a sensor body, and the common sensor body can be attached to the sensor base. In this case, for example, in the cleaning of the fire sensor which is effected periodically after installation, the sensor body is entirely removed from the sensor base, and is cleaned at a time, and then the sensor body is again attached to the sensor base. In such a case, there is an advantage that even if the sensor address has been determined, the sensor body can be again attached to the sensor base without paying any attention to the sensor address.

For example, EP 0362985 A1 and EP 0546401 A1 disclose the type of structure in which an address is set in a sensor base, a sensor body is attached to the sensor base, and the address set in the sensor base is read to be stored in the body. However, in the address-setting system of EP 0362985 A1, a plurality of mechanical elements for indicating binary address codes are provided on the base, and switch elements for reading the address code by judging whether the mechanical elements are present or absent are provided on the body. Therefore, the number of the elements is large (If it is desired to set 255 addresses, eight elements are required), and there is a risk that incomplete contact may be encountered. Particularly when the base is mounted on a warped ceiling surface, the elements are not disposed horizontally, so that the risk of incomplete contact is further increased. In the address-setting system of EP 0546401 A1, an EEPROM storing address codes is provided on the base, and when the body is attached to the base, the address code is read from the EEPROM. However, in this publication, there is no mention of a structure of fitting between an ID module having the EEPROM and the body. On the other hand, even in the same fire sensor, the structure of the base differs depending on whether the address setting is made in the sensor body or the sensor base, and to design and manufacture such structures independently increases the cost. Therefore, it is preferred to prepare address units which can be releasably attached to the sensor base, in which case a necessary one of the address units is selectively attached to the sensor base.

However, in the structure in which the address unit is to be attached to the sensor base, a problem arises as to how the structure of connection between the address unit (particularly of the type including a nonvolatile memory such as EEPROM) and the sensor body is designed. Namely, the fire sensor is usually provided with a fitting structure by which the sensor body is rotated to be fitted relative to the sensor base to thereby connect them together mechanically and electrically. Usually, this fitting is achieved through two remote terminals. In the type having movable terminals, the fitting is effected through three terminals.

On the other hand, the address unit incorporated in the sensor base requires a power line, signal lines for clock purposes and read-write purposes. Accordingly, for example, the connection through four terminals is needed. Therefore, the total number of the terminals for the sensor body and the sensor base is 6 to 7, and the conventional rotation-fitting structure can not be employed because of an installation space.

Therefore, it may be proposed that instead of using the rotation-fitting structure for the address unit, the signal wires are extended long enough to be connected by a connector. However, in such a structure in which the signal lines are extended from the address unit or the sensor body into a length allowing the rotation-fitting, and are connected to the mating unit by the connector, the originally-intended function of directly fitting the sensor base and the sensor body together is lost, and it is difficult to put this structure into practical use.

SUMMARY OF THE INVENTION

It is an object of the present invention to provide a pin-fitting structure of a base-mount type address unit, in which the address unit mounted on a sensor base can be electrically connected to a sensor body by a fitting structure for fitting the sensor body relative to the sensor base by rotation without extending signal lines.

The fire sensor of the present invention includes a sensor base, a sensor body and an address unit. The sensor base is mounted and fixed on a predetermined position, for example, a ceiling. The sensor body includes a plurality of pins for electrically connecting the sensor body with the sensor base, and a first fitting member for electrically and mechanically connecting the sensor body with the sensor base. The plurality of pins are formed on a surface of the sensor body connectable to the sensor base and circumferentially arranged on a circle with a predetermined radius. The sensor base has a second fitting member which is electrically and mechanically fitted to the first fitting member. The address unit is mounted on the sensor base, and includes a nonvolatile memory for electrically setting a readable address of the fire sensor, a first slide groove formed along a path of rotation movement of the plurality of pins, and a plurality of connector members formed along the first slide groove, each of the pins passing through the connector members and electrically connecting to each of the connector corresponding thereto. The plurality of pins are inserted in substantially perpendicular into the first slide groove, and then the sensor body is rotated to fit the pins to the connector members, respectively, and the first fitting member to the second member.

In the pin-fitting structure of the fire sensor according to the invention, the pins projecting from the sensor body are fitted in the first slide groove in the sensor base and the address unit, and then in accordance with the rotation of the sensor body, the pins are moved in and along the slide grooves into the rotation-finish position where the pins are electrically contacted with the associated connector members, respectively.

Therefore, for connecting the address unit, signal lines do not need to be extended, and the connection can be positively effected only by the pins formed on the sensor body, and the connector portion formed at the address unit.

BRIEF DESCRIPTION OF THE DRAWINGS

In the accompanying drawings.

PREFERRED EMBODIMENTS OF THE INVENTION

Preferred embodiments of the present invention will be described referring to the accompanying drawings as follows.

Figure 1:
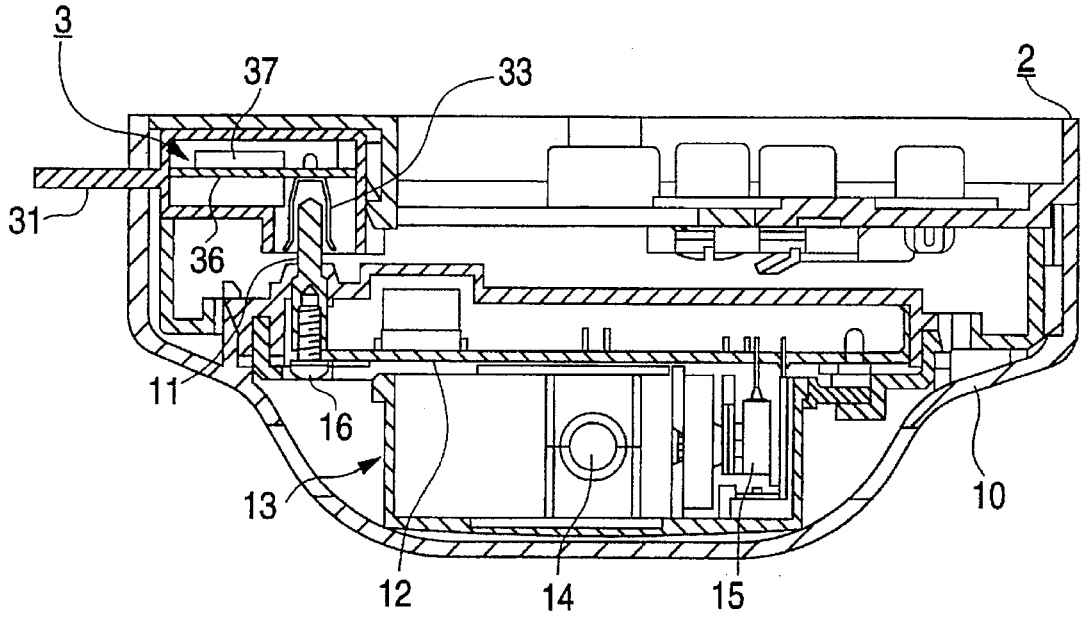
FIG. 1 is a cross-sectional view of an embodiment of a fire sensor of the invention.

FIG. 1 is a cross-sectional view of a fire sensor in which a pin-fitting structure of a base-mount type address unit is used. In FIG. 1, the fire sensor is comprised of a sensor body 10 and a sensor base 2. In this embodiment, this sensor is in the form of a scattering light-type smoke sensor. Accordingly, the sensor body 10 includes a smoke detection portion 13 having a light-emitting portion 14 and a light-receiving portion 15 therein. Here, since the sensor is of the scattering light-type, the light-receiving portion 15 is not disposed in opposed relation to the light-emitting portion 14.

A circuit receiving portion is formed at an upper portion of the sensor body 10 in which the printed circuit board 12 is received so that a sensor circuit is installed. Lead wires of a light-emitting element of the light-emitting portion 14 and lead wires of a light-receiving element of the light-receiving portion 15 are soldered to the board 12.

Figure 2:
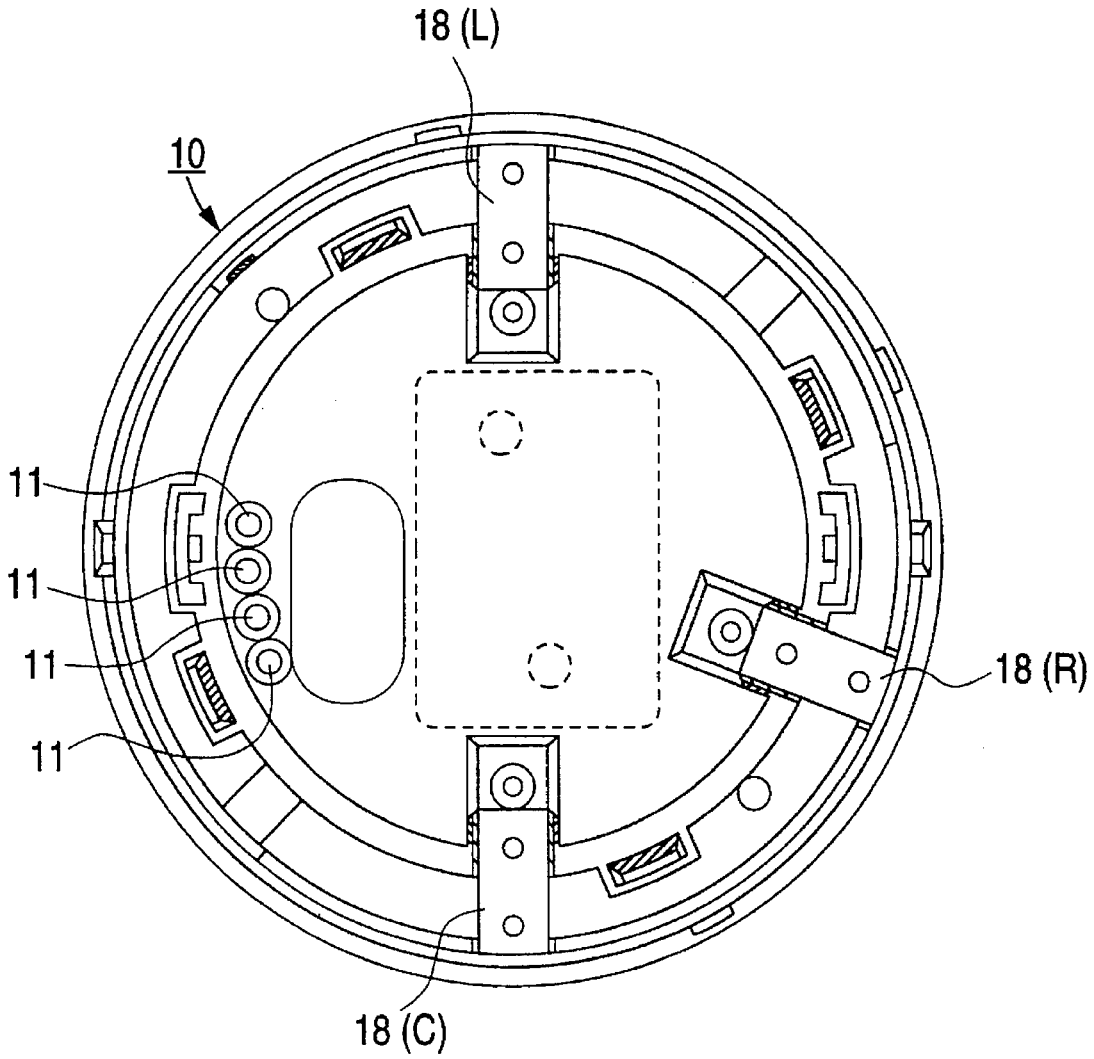
FIG. 2 is a plan view showing a fitting side of a sensor body.

Pins 11 are integrally formed on a fitting surface of the sensor body 10 with respect to the sensor base 2 while it is projected from the surface. Within the circuit receiving portion, the pins 11 are connected to the printed circuit board 12 by screws 16. FIG. 2 is a plan view of the sensor body 10, showing its fitting side or surface. Three L-shaped fitting terminals 18 are mounted on three portions of the sensor body. The four pins 11 used for connection to an address unit 3 (described later), project from the fitting surface.

Figure 3:
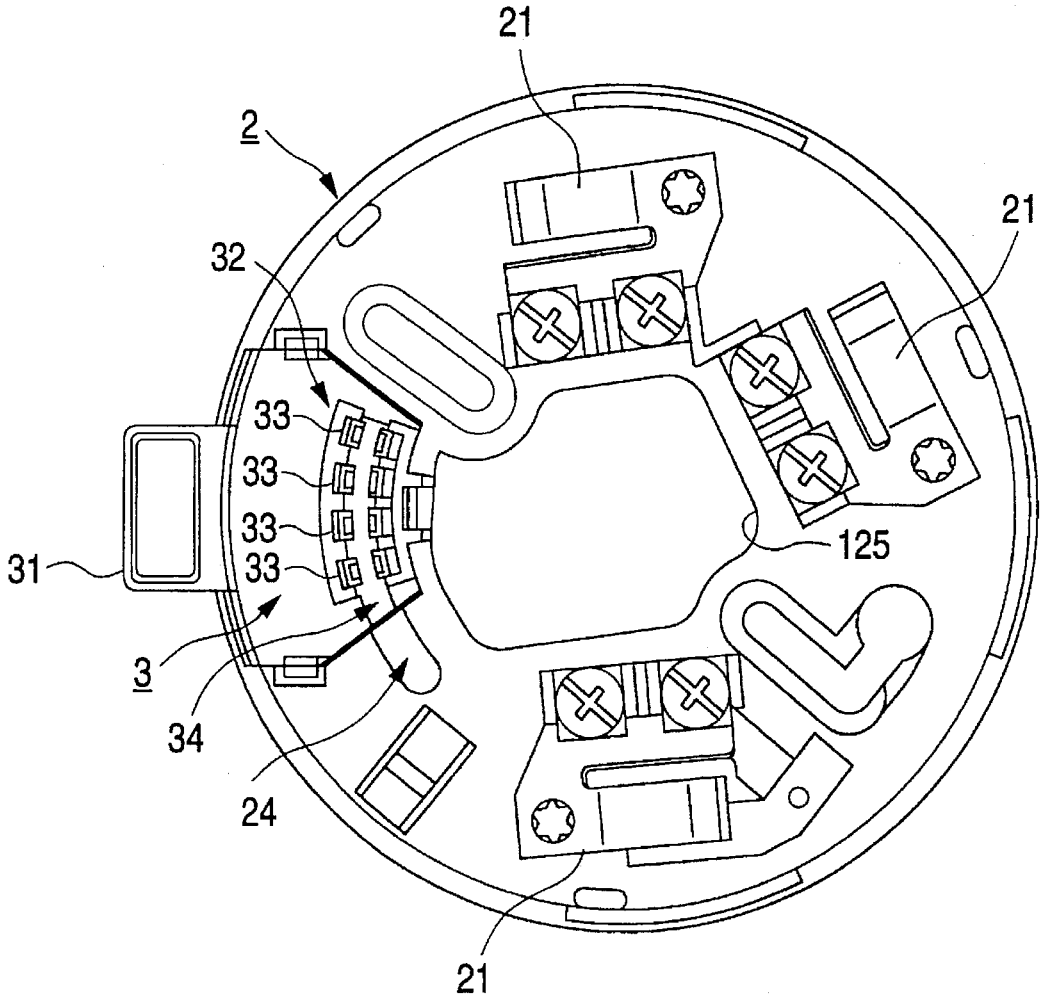
FIG. 3 is a plan view showing an inner side of a sensor base.

Referring again to FIG. 1, the address unit 3 is incorporated in the sensor base 2 from the inner side thereof. FIG. 3 is a plan view of the sensor base 2 showing its inner side facing the fitting side of the sensor body 10 of FIG. 1. In FIG. 3, three fitting metal members 21 are formed respectively on those portions of the fitting surface of the sensor base 2 corresponding respectively to the fitting terminals 18 shown in FIG. 2 on the sensor body 10. An address unit-receiving portion 23 is formed in an empty region where the fitting metal members 21 are not provided. The address unit 3 is received in this receiving portion 23. The address unit 3 has an outwardly-projecting grip portion 31, and has an arcuate slide groove 34 formed in a fitting surface thereof, the slide groove 34 being radially spaced a predetermined distance from the center or axis of the sensor base 2. Metal connector members 33 corresponding respectively to the pins 11 shown in FIG. 2 of the sensor body 10 are arranged along this slide groove 34.

Each metal connector member 33 has two contact piece portions disposed respectively on opposite sides of the slide groove 34 in an upstanding manner, and the pin 11 can pass through the space between the two contact piece portions. The slide groove 34 and the four metal connector members 33 jointly constitute a female connector portion 32 of the address unit 3. A slide groove 24 is formed in the sensor base 2 continuously with the starting end of the slide groove 34 in the address unit 3.

Regarding to this slide groove 24, a rotational angle θ is predetermined for fitting the fitting terminals 18 in the sensor body 10 with respect to the respective fitting metal members 21 in the sensor base 2 by rotation. In accordance with this rotational angle θ, the pins 11 of the sensor body 10 are rotated or angularly moved to be fitted respectively in the metal connector members 33 of the female connector portion 32 of the address unit 3. The slide groove 24 is formed to provide the groove of a circumferential length suited for the rotational angle θ.

In the condition in which the sensor body 10 is thus rotated to be fitted relative to the sensor base 2, the pins 11 projecting from the sensor body 10 are fitted respectively in the downwardly-open metal connector members 33 of the address unit 3 incorporated in the sensor base 2 as shown in FIG. 1, so that a memory circuit 37 provided on a printed circuit board 36 contained in the address unit 3 is electrically connected to the sensor circuit packaged on the printed circuit board 12 on the sensor body 10. Incidentally, reference numeral 125 represents a wire passage hole for passing wires from the ceiling therethrough.

Figure 4A:
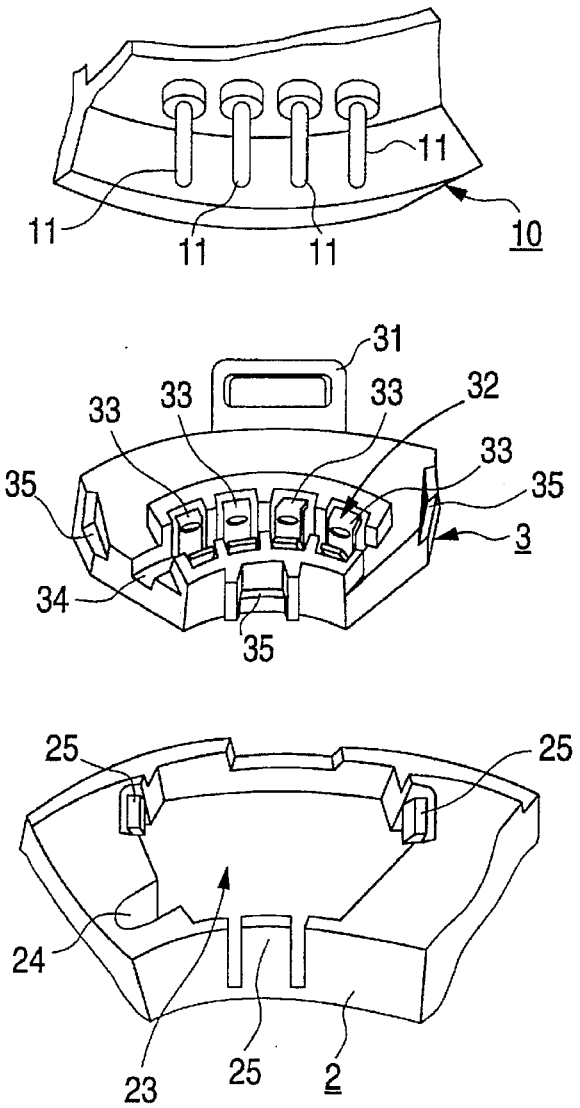
FIG. 4A is an exploded perspective view showing a base-mount type address unit of the present invention.

FIG. 4A is an exploded perspective view showing the address unit 3 and the sensor body 10. The address unit-receiving portion 23 is formed as a recess in the sensor base 2, and has a shape corresponding to a generally-fan shape of the address unit 3. Engagement projections 25 are formed at a peripheral portion of the address unit-receiving portion 23. The slide groove 24 is formed in one inner surface of this receiving portion 23.

Three engagement projections 25 are formed to stand at the periphery of the address unit receiving portion 23, and a claw portion is formed on the inside of each of the projections 25 at the neighbor of the top end portion thereof. The engagement projection 25 has a taper shape from the claw portion to the top end thereof. The engagement projection 25 is elastic, so that when the address unit 3 is pushed into the address unit receiving portion 23, the side surface of the address unit 3 attaches to the engagement projections 25 to be pushed to the outside. When fitting recesses 35 formed on the side surface of the address unit 3 across the claw portion of the engagement projection 25, the claw portions are fitted to the fitting recesses 35.

In addition, when the address unit 3 is taken off from the address unit receiving portion 23, the outwardly-projecting grip portion 31 is lifted so that the fitting recesses 35 push out the claw of the engagement projections 25 to the outside. Consequently, the engagement projections 25 can across the claw portion to take off. Thus, the address unit 3 is detachably received on the address receiving portion 23.

The address unit 3 includes the female connector portion 32 having the four connector members 33 arranged along the slide groove 34, and the address unit 3 has fitting recesses 35 for fitting respectively on the fitting projections 25 of the address unit-receiving portion 23. The four pins 11 project from the fitting surface of the sensor body 10 into such a length that the pins 11 can be connected to the female connector portion 32 of the address unit 3.

Figure 4B:
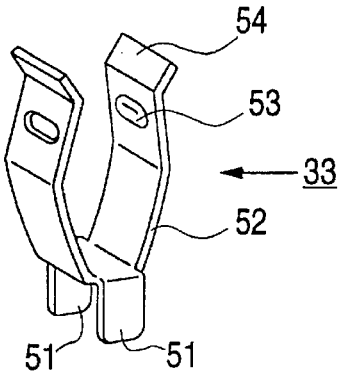
FIG. 4B is a perspective view showing a structure of a connector member of the address unit.
Figure 4C:
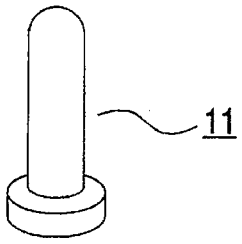
FIG. 4C is a perspective view showing a pin of the base-mount type address unit.

FIG. 4B is a perspective view showing a structure of the connector member 33. The connector member 33 is constituted by leg portions 51, contact pieces 52, and inwardly projecting portions 53, which are integrally formed. The connector member 33 is preferably gold plated. The connector member 33 is fitted in the printed circuit board of the address unit 3 by the leg portions 51. The contact piece 52 has a outwardly curved portion 54 so that the pin 11 is easily pass through or inserted between a pair of contact pieces 52. The inwardly projecting portion 53 is provided under the outwardly curved portion 54 so as to enhance the electrical contact between the pin 11 and the connector member 33 during their fitting condition. That is, the pin 11 is surely contacted with the connector member 33 by the inwardly projecting portion 53. The contact piece 52 curves outwardly from the bottom to the center and curves inwardly from the center to the top. Incidentally, as shown in FIG. 4C, the shape of the pin 11 is preferably cylindrical and having a substantially half sphere portion at the top thereof.

Figure 5:
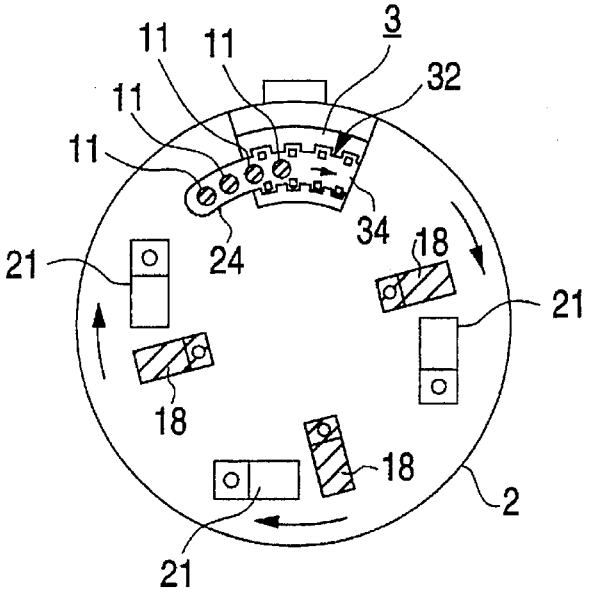
FIG. 5 is a view showing the manner of fitting the sensor body and the sensor base by rotating the sensor body relative to the sensor base.

FIG. 5 shows the manner of fitting the pins in the pin-fitting structure of the base-mount type address unit of the invention by rotating the sensor body relative to the sensor base. FIG. 5 shows a condition in which the sensor body 10 is positioned with respect to the sensor base 2, and is connected thereto in a vertical direction, the pins 11 and the fitting terminals 18 being shown by hatching.

In this initial condition in which the sensor body is thus connected to the sensor base in the vertical direction, the fitting terminals 18 are opposed respectively to open sides of the fitting metal members 21 of the sensor base 2. The four pins 11 projecting from the sensor body 10 are disposed in the rotation-starting portion formed mainly by the slide groove 24 in the sensor base 2.

In this condition, when the sensor body 10 is rotated or angularly moved right as indicated by an arrow, the fitting terminals 18 are fitted respectively in the fitting metal members 21 of the sensor base 2. At the same time, the four pins 11 disposed in the rotation-starting portion in the slide grooves 24 and 34 are rotated right, and the leading-side pins 11 pass through the connector members 33 of the female connector portion 32 of the address unit 3, and finally the four pins 11 are fitted in the corresponding connector members 33, respectively.

Figure 6:
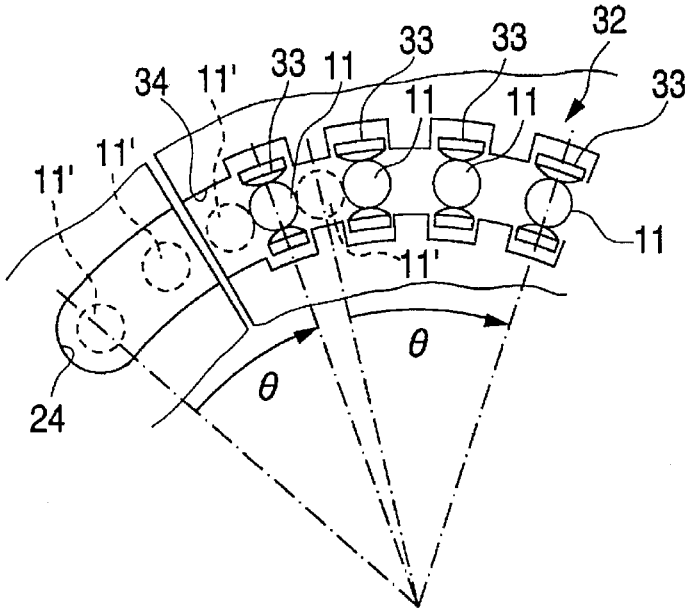
FIG. 6 is a view showing the relation between pins and a female connector portion in the rotation fitting operation shown in FIG. 5.

FIG. 6 show the relation between the pins 11 and the connector members 33 on an enlarged scale. In the initial condition in which the sensor body 10 is connected to the sensor base 2 in the vertical direction, the two left-side pins 11' are received in the slide groove 24 in the sensor base 2 while the other or two right-side pins 11 are received in the slide groove 34 in the address unit 3, and are disposed respectively on opposite sides of the first connector member 33.

In this condition, when the sensor body 10 is rotated right through the fitting rotational angle θ, the leading-side pins 11 move to their associated connector members 33 while passing through and expanding the other connector members 33. Finally, the four pins 11 are fitted in and firmly connected to the associated connector members 33, respectively, in such a manner that each pin 11 is held by the associated connector member 33 from the opposite sides. The fitting terminals 18 are fitted in the fitting metal members 21, respectively.

When it is desired to remove the sensor body 10 from the sensor base 2, the sensor body 10 is rotated in a reverse direction, that is, left, so that the pins 11 are moved along the slide grooves 34 and 24 to be disengaged from the female connector portion of the address unit 3, and the sensor body 10 can be removed.

As a result, the sensor body 2 can be attached to and detached from the sensor base by rotation as in the conventional structure without particularly paying attention to whether or not the address unit 3 is mounted on the sensor base 2. With respect to the appearance, the grip portion 31 of the address unit 3 is projected from the side surface of the sensor base 2, and therefore it can be judged whether or not the address unit 3 is incorporated in the sensor base 2.

Figure 7:
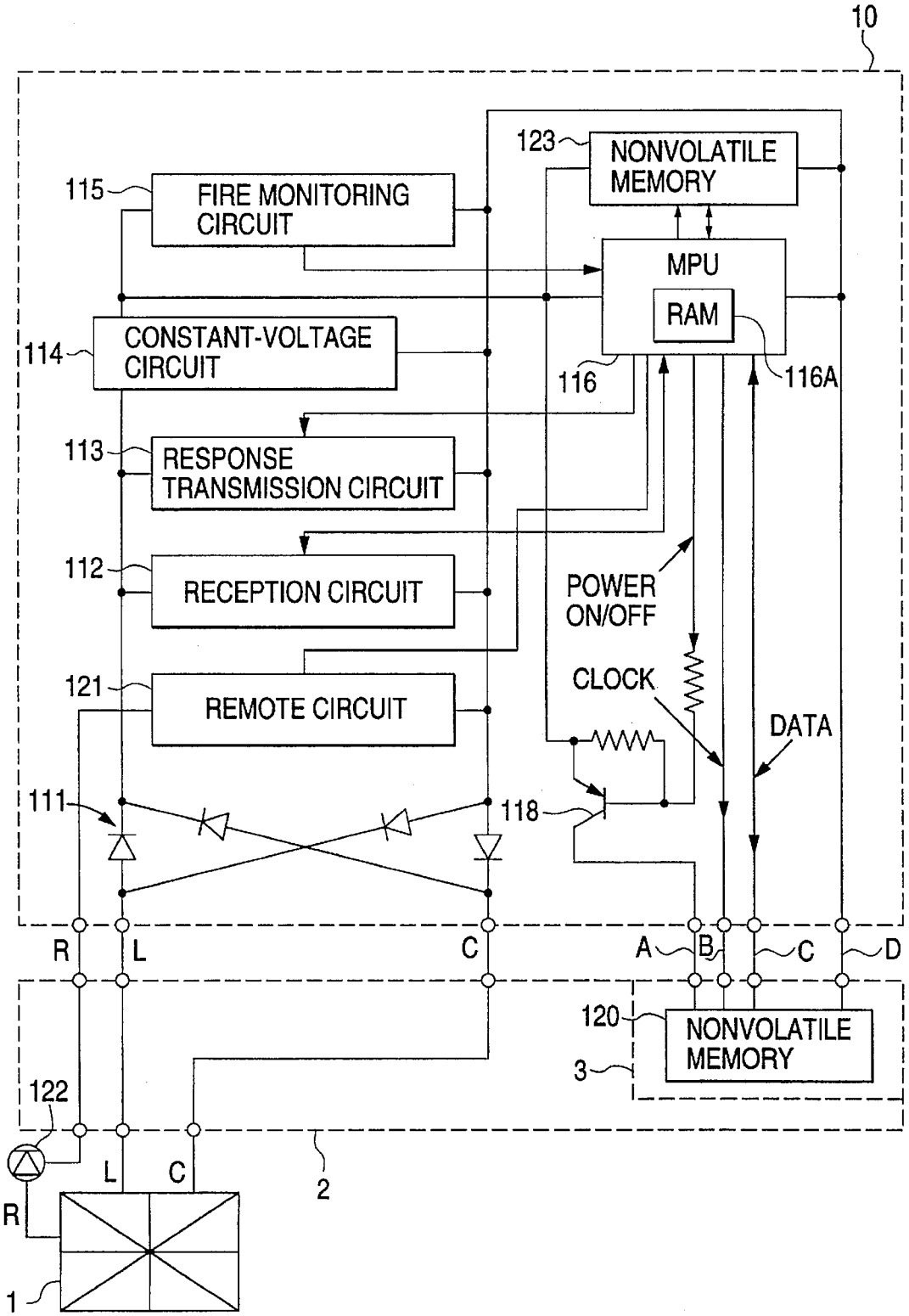
FIG. 7 is a block diagram of a circuit of the sensor of the present invention.

FIG. 7 is a block diagram of the circuit of the fire sensor of FIG. 1 in which the address unit 3 is incorporated in the sensor base 2.

In FIG. 7, sensor lines L, C and R extending from a control panel 1 are connected to the sensor base 2. The sensor lines L and C are connected to the sensor body 10 via the sensor base 2, and supply electric power from the control panel 1 via a diode bridge 111. The sensor line R are connected to the sensor body 10 via a indication lamp 122 and the sensor base 2, and further connected to a remote circuit 121. The remote circuit 121 controls the indication lamp 122, for example, indicating whether or not fire occurs, in accordance with signal from an MPU 116. A reception circuit 112 and a response transmission circuit 113 are connected to the diode bridge 111, and further a fire monitoring circuit 115 is connected to a constant-voltage circuit 114. In the embodiment of the invention, the fire monitoring circuit 115 has a circuit serving as a scattering light-type smoke sensor.

There is provided the MPU 116 which operates upon reception of power from the constant-voltage circuit 114. Address setting is made relative to the MPU 116 by a nonvolatile memory 120 of the address unit 3 incorporated in the sensor base 2. For example, an EEPROM may be used as the nonvolatile memory 120. Power lines A and D and signal lines B and C are connected between the sensor base 2 and the address unit 3.

A transistor 118 controlled between the ON-state and the OFF-state by the MPU 116 serves to control the supply of power to the nonvolatile memory 120. Usually, a predetermined address has been written in the nonvolatile memory 120 of the address unit 3 by a ROM writer. When the power is first supplied from the control panel 1, MPU 116 effects a set-up operation to read a sensor address of the nonvolatile memory 120 provided in the address unit 3, and stores it in a RAM 116A in MPU 116. The sensor address is also stored in a nonvoluntary memory 123, i.e., EEPROM, provided in the sensor. Usually, the MPU 116 conducts the polling between the control panel 1 by using the address stored in the RAM 116A. This is used for address judgement for polling from the control panel 1.

Incidentally, the sensor body 10 is taken off from the sensor base 2 due to cleaning the sensor. Thereafter, when the sensor body 10 is mounted on the sensor base 2, the address unit may be broken or lost. In this case, the MPU 116 reads out the address data stored in the nonvoluntary memory 123 and stores it in the RAM 116A to be used.

Figures 8A, 8B, 8C, 8D:
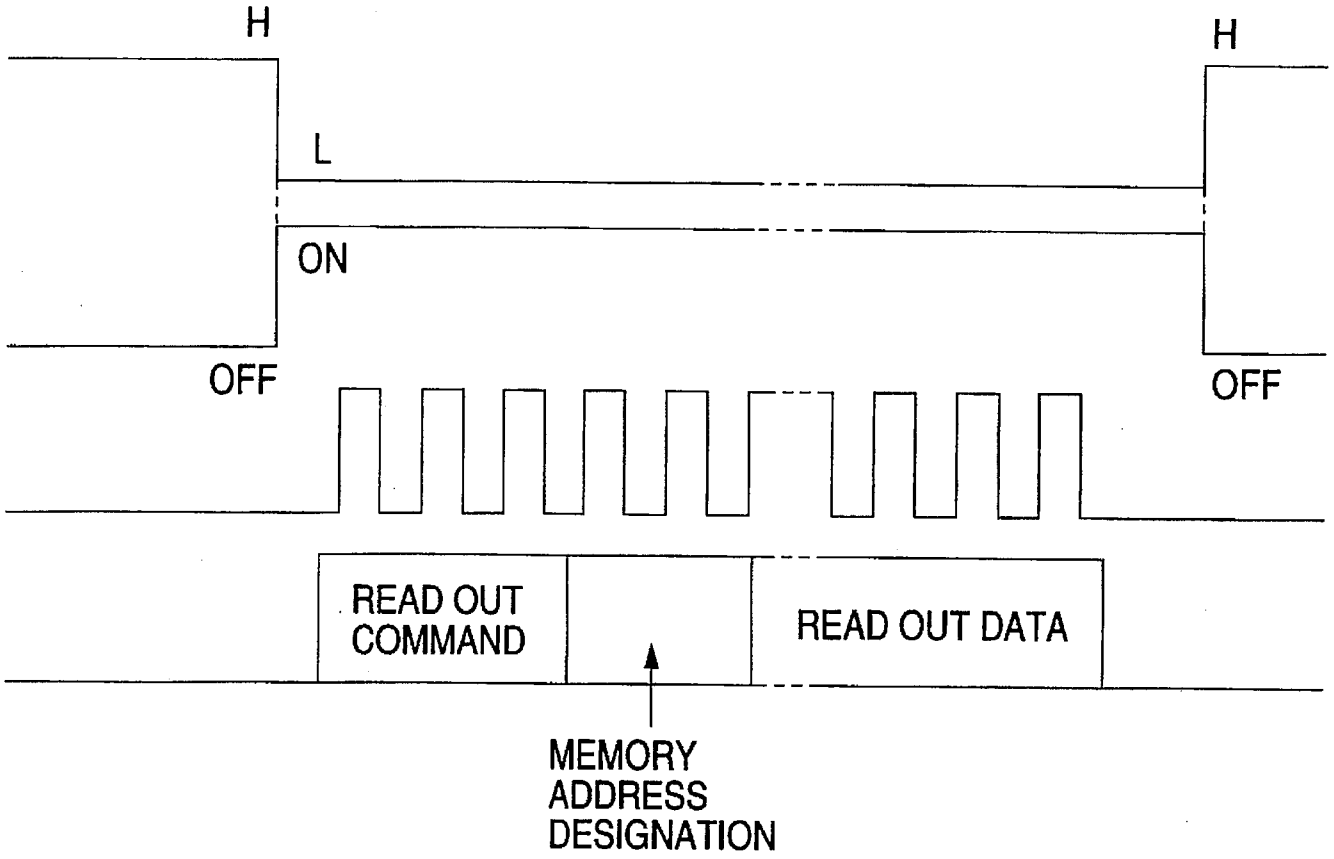
FIGS. 8A to 8D are timing charts of a memory access of the address unit.

FIGS. 8A to 8D show the reading from the nonvolatile memory 120 by MPU 116. First, MPU 116 changes the control voltage for the base of the transistor 118 from a H (high) level to an L (low) level, as shown in FIG. 8A. As a result, the transistor 118 is turned on, and the power is supplied to the nonvolatile memory 120, thus bringing it into an operative condition, as shown in FIG. 8B. Then, MPU 116 supplies a clock signal (FIG. 8C) to the nonvolatile memory 120 via the signal line B, and in synchronism with this clock, MPU 116 feeds a read instruction, and designates a memory address via the signal line C as shown in FIG. 8D, and in response to this, the sensor address (read-out data) is read from the nonvolatile memory 120, and is inputted into MPU 116. After the reading of the sensor address is completed, MPU 116 returns the output of the base of the transistor 118 to the H level, thereby stopping the power supply.

Although the above embodiment is directed to the scattering light-type smoke sensor, the present invention is not limited to such a sensor, and the invention can be applied to any other suitable fire sensor, such as an ionized type smoke sensor and a heat sensor, requiring a sensor address.

As described above, in the present invention, the connection pins project from the sensor body relative to the address unit, and when the sensor body is rotated relative to the sensor base, with the pins received in the slide grooves in the sensor base and the address unit, the pins are brought into electrical contact respectively with the metal connector members of the female connector portion juxtaposed along the slide groove in the address unit. Thus, the connection of the address unit can be positively achieved without extending the signal lines, utilizing the rotation fitting of the sensor body relative to the sensor base.

What is claimed is:

1. A fire sensor comprising:

a sensor base mounted and fixed on a predetermined position;

a sensor body including a plurality of pins, and a first fitting member for electrically and mechanically connecting said sensor body with said sensor base, said plurality of pins being formed on a surface of said sensor body and circumferentially arranged on a circle with a predetermined radius, said sensor base having a second fitting member which is electrically and mechanically fitted to said first fitting member; and an address unit mounted on said sensor base, said address unit including a nonvolatile memory for electrically setting a readable address of said fire sensor, a first slide groove formed on a surface of said address unit along a path of rotational movement of said plurality of pins provided during mating of the address unit on the sensor base with the sensor body, and a plurality of connector members formed along said first slide groove, each of said pins passing through said connector members and electrically connecting to one of said connector members corresponding thereto upon said mating for electrically connecting the address unit and the sensor body to provide a signal path therebetween;

wherein said plurality of pins are received in said first slide groove, and said sensor body is rotated to fit said pins to said connector members, respectively, and said first fitting member to said second fitting member.

2. A fire sensor according to claim 1, wherein said sensor base has a second slide groove which is continuous with said first slide groove and formed along a path of rotation movement of said plurality of pins;

wherein said plurality of pins are inserted in a substantially perpendicular manner into said first slide groove, and then said sensor body is rotated to fit said pins to said connector members.

3. A fire sensor according to claim 1, wherein a shape of said pin is cylindrical and having a substantially half sphere portion at the top thereof.

4. A fire sensor according to claim 1, wherein each said connector members includes a leg portion which is fitted in a printed circuit board packed in said address unit, and a pair of contact portions having inwardly projecting portions at an upper portion thereof for contacting with said pin, said leg portion and said contact portions being formed integrally.

5. A fire sensor according to claim 1, wherein the first groove is formed to provide said groove of a circumferential length suited for the rotational angle which is necessary for rotation fitting of said first fitting member with respect to said second fitting member.

6. A fire sensor according to claim 1, wherein said sensor body has a plurality of first fitting members, said sensor base has a plurality of second fitting members, and the number of said plurality of first fitting members is equal to that of said plurality of second fitting members.

7. A fire sensor according to claim 1, wherein the number of said plurality of pins is equal to that of said plurality of connector members.

8. A fire sensor according to claim 1, wherein said nonvolatile memory is an EEPROM.

9. A fire sensor according to claim 1, wherein said sensor base has an address unit receiving portion, and said address unit is detachably received on said address receiving portion.

10. A fire sensor according to claim 9, wherein said address unit receiving portion has a second slide groove which is continuous with said first slide groove and formed along a path of rotation movement of said plurality of pins;

wherein said plurality of pins are inserted in a substantially perpendicular manner into said first slide groove, and then said sensor body is rotated to fit said pins to said connector members.

11. A fire sensor according to claim 9, wherein said address unit has a grip portion which is projected from a side surface of said sensor base.

* * * * *